United States Patent [19]

Ashfield et al.

[11] 3,931,812

[45] Jan. 13, 1976

[54] INTERNAL COMBUSTION ENGINES

[75] Inventors: Herbert Edward Ashfield; Charles Hartley Hull, both of Huddersfield, England

[73] Assignee: David Brown Tractors Limited, Huddersfield, England

[22] Filed: Aug. 13, 1973

[21] Appl. No.: 387,738

[30] Foreign Application Priority Data

Sept. 6, 1972 United Kingdom ..... 41233/72

[52] U.S. Cl. ..... 123/73 S; 123/73 R; 123/196 CP

[51] Int. Cl.[2] ..... F02B 33/04

[58] Field of Search ..... 123/65 BA, 73 C, 73 S, 123/73 R, 196 CP, 65 B, 41.86, 196 A

[56] References Cited

UNITED STATES PATENTS

| | | | |
|---|---|---|---|
| 1,733,431 | 10/1929 | Sherman | 123/73 S |
| 2,357,522 | 9/1944 | Kelly | 123/196 CP |
| 2,682,259 | 6/1954 | Watkins | 123/196 CP X |
| 2,893,362 | 7/1959 | Dalrymple | 123/196 CP X |
| 2,959,164 | 11/1960 | Janeway et al. | 123/196 CP X |

FOREIGN PATENTS OR APPLICATIONS

| | | | |
|---|---|---|---|
| 144,847 | 6/1920 | United Kingdom | 123/196 CP |
| 36,243 | 1/1913 | Sweden | 123/73 S |

*Primary Examiner*—Wendell E. Burns
*Assistant Examiner*—David D. Reynolds
*Attorney, Agent, or Firm*—Norris & Bateman

[57] ABSTRACT

A multi-cylinder 2-stroke fuel injection engine of the crankcase compression type has a separate crank chamber associated with each cylinder and inlet, transfer and exhaust ports in each cylinder. The exhaust ports of the engine communicate with an exhaust manifold which communicates with the turbine of an exhaust gas driven scavenge compressor, and the impeller of the compressor communicates with an inlet manifold which communicates with the inlet ports of the engine so as to pressure charge each crank chamber and thus increase the mass of air subsequently pumped to the associated cylinder by way of its transfer port.

6 Claims, 2 Drawing Figures

INTERNAL COMBUSTION ENGINES

BACKGROUND OF INVENTION

The invention relates to internal combustion engines, and more particularly to engines operating on the 2-stroke cycle with fuel injection.

It has hitherto been accepted that an exhaust gas driven scavenge compressor was not practicable for use with 2-stroke engines in general, as such a compressor cannot provide scavenge air for starting or for running at low or varying load levels.

SUMMARY OF INVENTION

According to the invention, a multi-cylinder 2-stroke fuel injection engine of the crankcase compression type with inlet, transfer and exhaust ports in each cylinder has the turbine of a scavenge compressor driven by its exhaust and the impeller of said compressor discharging to its inlet.

BRIEF DESCRIPTION OF DRAWINGS

A preferred embodiment of the invention will now be described, by way of example only, with reference to the accompanying drawings of which.

DESCRIPTION OF PREFERRED EMBODIMENT

Figure 1:
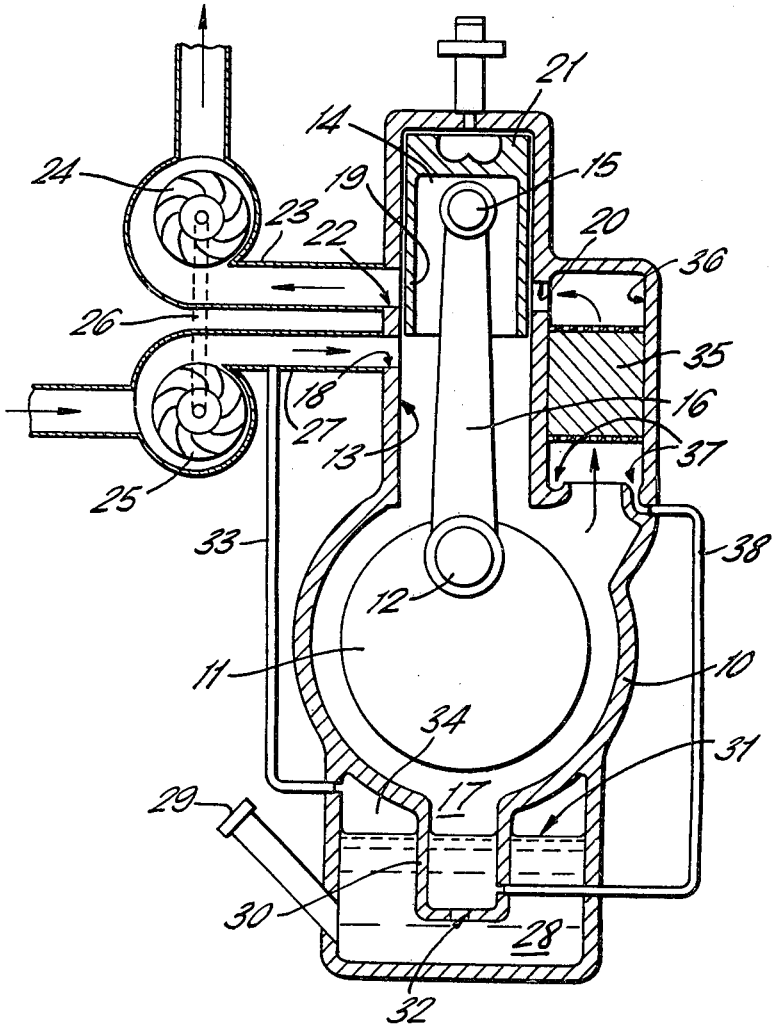
FIG. 1 is a transverse section through an internal combustion engine.
Figure 2:
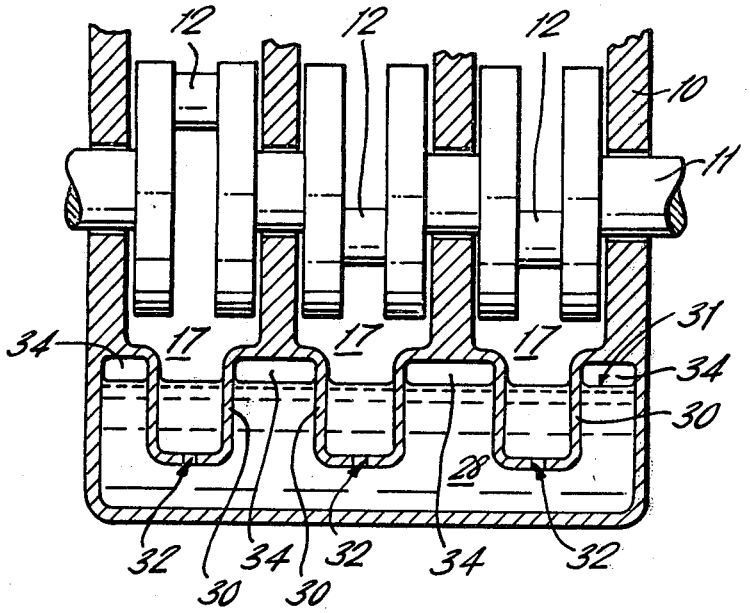
FIG. 2 is a sectional side elevation of the crankshaft and sump of said engine.

Referring now to the drawings, a 2-stroke 3-cylinder diesel engine has a crankcase 10 in which there is rotatably mounted a crankshaft 11 having crankpins 12, and cylinders 13 in each of which there is reciprocable a piston 14 carrying a gudgeon pin 15 connected to the associated crankpin 12 by a connecting rod 16. The engine is of the crankcase compression type, necessitating separate crank chambers 17. Each cylinder 13 has an inlet port 18 which is exposed by the skirt 19 of the piston 14 slidable in said cylinder so as to communicate with the associated crank chamber 17 when the crankpin 12 therein is in the vicinity of top dead centre, a transfer port 20 which communicates with said crank chamber and is exposed by the crown 21 of said piston when said crankpin is in the vicinity of bottom dead centre, and an exhaust port 22 diametrically opposite the transfer port 20 and so arranged that it commences to be exposed by the piston crown 21 slightly before the transfer port 20 commences to be exposed thereby as said crankpin moves towards bottom dead centre. The exhaust ports 22 of the engine communicate with an exhaust manifold 23 which communicates with the turbine 24 of an exhaust gas driven scavenge compressor, the impeller 25 of the latter being secured to the same shaft 26 as the turbine 24 and arrange to communicate with an inlet manifold 27 which communicates with the inlet ports 18 of the engine so that said impeller discharges air to said ports.

The engine has a pressurised lubrication system including a sump 28 having a filler cap 29 and a dipstick (not shown) which are adapted to prevent the egress of oil while the engine is running, and each crank chamber 17 has a cylindrical extension 30 at its lower end which projects below the level 31 of oil in the sump 28. Each extension 30 communicates with the sump 28 below the level 31 of oil therein by way of an orifice 32 of restricted size. The purpose of these orifices 32 is to permit oil draining from the upper part of the engine to return to the sump 28 whilst minimising surging of oil due to the out-of-phase pressure variations occurring in the crank chambers 17. An additional measure to minimise such surging comprises a pressure balance pipe 33 connecting an air space 34 above the oil in the sump 28 to the inlet manifold 27 on the discharge side of the impeller 25.

To avoid excessive lubricating oil consumption and the danger of the engine speed becoming out of control, an oil mist filter 35 is disposed in a vertical transfer passage 36 leading to each transfer port 20 to remove from the air lubricating oil atomised by motion, pressure and heat within the engine. The entry to the lower end of each passage 36 from the associated crank chamber 17 is surrounded by an annular trough 37 into which oil drains from the filter 35, and the trough 37 is connected by an oil return pipe 38 to the associated cylindrical extension 30 below the level 31 of oil in the sump 28 to prevent loss of scavenge air pressure from the crank chamber 17.

In operation, sufficient scavenge air for starting and for running at low or varying load levels is provided by the compression of air in each crank chamber 17 as the crankpin 12 therein moves towards bottom dead centre culminating in the pumping of some of said air to the associated cylinder 13 by way of its transfer port 20. When the engine is running at the higher load levels demanded by normal operations, the flow rate of its exhaust gases is ample to drive the turbine 24 of the scavenge compressor the impeller 25 of which then acts to pressure charge each crank chamber 17 while the associated inlet port 18 is open and thereby substantially increase the mass of air subsequently pumped to the associated cylinder 13 by way of its transfer port 20.

In a modification, each cylindrical extension 30 communicates with the sump 28 below the level 31 of oil therein by way of a non-return valve opening towards the sump 28, instead of by way of an orifice 32 of restricted size. In another modification, the engine is a petrol injection engine instead of a diesel engine.

What we claim is:

1. A multi-cylinder 2-stroke injection engine of the crankcase compression type comprising inlet, transfer and exhaust ports in each cyliner; a scavenge compressor including a turbine connected to the engine's exhaust ports and an impeller connected to the engine's inlet ports; a pressurized lubrication system including a sump containing oil under a pressure greater than atmospheric for forcing oil from the sump to lubricate the moving parts of the engine; means defining a separate crank chamber for each cylinder projecting below the level of oil in the sump; a transfer passage connecting each crank chamber to the transfer port in the associated cylinder; and means on each chamber defining means providing an opening communicating each of said chambers with said sump for permitting oil to return from each crank chamber to the sump below said level.

2. An engine according to claim 1, wherein each crank chamber communicates with the sump by way of an orifice of restricted size.

3. An engine according to claim 1, further comprising means defining an air space above the level of oil in the sump, and a pressure balance pipe connecting said air space to the connection between the impeller and the engine's inlet ports.

4. An engine according to claim 1, wherein each transfer passage contains an oil mist filter.

5. An engine according to claim 4, wherein the filter is connected by drain means to the associated crank chamber below the level of oil in the sump.

6. An engine according to claim 5, wherein the drain means comprise a trough below the filter and an oil return pipe connecting said trough to the associated crank chamber.

* * * * *